US009382786B2

(12) United States Patent
Pesek et al.

(10) Patent No.: US 9,382,786 B2
(45) Date of Patent: Jul. 5, 2016

(54) ROTATING FLEXIBLE JOINT FOR USE IN SUBMERSIBLE PUMPING SYSTEMS

(71) Applicant: Baker Hughes Incorporated, Houston, TX (US)

(72) Inventors: Sergio Alejandro Pesek, Owasso, OK (US); Luis A. Moncada, Tulsa, OK (US); Scott Clayton Strattan, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 216 days.

(21) Appl. No.: 14/132,743

(22) Filed: Dec. 18, 2013

(65) Prior Publication Data

US 2014/0169988 A1 Jun. 19, 2014

Related U.S. Application Data

(60) Provisional application No. 61/739,561, filed on Dec. 19, 2012.

(51) Int. Cl.
*E21B 17/20* (2006.01)
*E21B 43/12* (2006.01)
*F04B 47/02* (2006.01)

(52) U.S. Cl.
CPC ..... *E21B 43/128* (2013.01); *F04B 47/02* (2013.01)

(58) Field of Classification Search
CPC ..... E21B 43/128; F04B 47/02
USPC ..... 464/18, 19, 171; 285/261, 262, 271; 175/320–326; 417/53, 410.1; 166/66.4
See application file for complete search history.

(56) References Cited

U.S. PATENT DOCUMENTS 980,296 A * 1/1911 Lehman ..... F16D 3/848 464/171 X
2,737,119 A * 3/1956 Hill ..... F04C 2/1073 417/410.1 X
2,902,843 A * 9/1959 Forbes ..... F16D 3/16 464/171 X
2,929,232 A * 3/1960 Muller ..... F16D 3/848 464/171 X
4,062,412 A * 12/1977 McIlvanie ..... E21B 7/02 464/19 X
2014/0179448 A1* 6/2014 Collins ..... E21B 43/128

* cited by examiner

*Primary Examiner* — Gregory Binda
(74) *Attorney, Agent, or Firm* — Bracewell LLP

(57) ABSTRACT

An electrical submersible pumping system (ESP) for pumping fluids from a wellbore is made of segments, which include a motor, a seal section, a pump, and a shaft assembly connected to an output of the motor drives the pump. The motor, seal section, and pump are elongate members and coupled end to end to one another by housing connectors and shaft connectors. At least one of the housing connectors and shaft connectors have portions that are pivotable with other portions, so that adjacent segments of the ESP system can pivot with respect to one another. The housing connector can be a ball and socket assembly, where the ball fits within a spherically shaped chamber in the socket assembly. Opposing ends of the housing connector can mount to respective segments by threads or bolt flanges. The pivotal shaft connector may be a universal joint.

18 Claims, 2 Drawing Sheets

ROTATING FLEXIBLE JOINT FOR USE IN SUBMERSIBLE PUMPING SYSTEMS

CROSS-REFERENCE TO RELATED APPLICATION

This application claims priority to provisional application 61/739561, filed Dec. 19, 2012.

FIELD OF THE DISCLOSURE

The present disclosure relates in general to electrical submersible well pump assemblies, and in particular o a well pump assembly having segments that are coupled to each other by a connector that allows pivoting between adjacent segments.

BACKGROUND

In oil wells and other similar applications in which the production of fluids is desired, a variety of fluid lifting systems have been used to pump the fluids to surface holding and processing facilities. It is common to employ various types of downhole pumping systems to pump the subterranean formation fluids to surface collection equipment for transport to processing locations. One such conventional pumping system is a submersible pumping assembly which is supported and immersed in the fluids in the wellbore. The submersible pumping assembly includes a pump and a motor to drive the pump to pressurize and pass the fluid through production tubing to a surface location. A typical electrical submersible pump assembly ("ESP") includes a submersible pump, an electric motor and a seal section interdisposed between the pump and the motor. Sometimes the ESP assembly can include a separator to isolate fluids of different phases from one another. Depending on the particular application, the pump is usually a centrifugal pump or a progressing cavity pump.

Not all wells from which fluid is pumped with an ESP assembly are vertical. Some wells are deviated, i.e. not vertical, and some have are highly deviated and include horizontal portions. Because the upper portions of substantially all wells are vertical, wells having a horizontal portion bend when transitioning from vertical to horizontal. The bend in the well can introduce difficulties when deploying the ESP assembly, as the segments of the ESP assemblies form an elongate rigid member; which must flex to the same radius as the bend when being inserted downhole.

SUMMARY

The electrical submersible pump assembly disclosed herein has segments attached end to end and including a motor, a pump, and a seal section between the pump and the motor. Each of the segments has a housing and a rotatable shaft. At least one pivotal housing connector is attached between the housings of adjacent segments, allowing pivoting of the housings relative to each other. At least one pivotal shaft connector is attached between the shafts of adjacent segments. The shaft connector allows pivoting of the shafts of adjacent segments.

Preferably, the pivotal shaft connector is a universal joint mounted within the pivotal housing connector. The pivotal housing connector prevents axial rotation of one of the housings relative to the other of the housings. In the embodiment shown, the pivotal housing connector has two flanges facing in opposite directions. The flanges are bolted or secured by threads to the housings.

The pivotal housing connector may comprises a ball and socket arrangement. A key and slot located between the socket and the ball element prevent axial rotation of one of the housings relative to the other of the housings.

BRIEF DESCRIPTION OF THE DRAWINGS

Some of the features and benefits of the present disclosure having been stated, others will become apparent as the description proceeds when taken in conjunction with the accompanying drawings, in which.

While the subject device and method will be described in connection with the preferred embodiments but not limited thereto. On the contrary, it is intended to cover all alternatives, modifications, and equivalents, as may be included within the spirit and scope of the present disclosure as defined by the appended claims.

DETAILED DESCRIPTION

The present disclosure will now be described more fully hereinafter with reference to the accompanying drawings in which exemplary embodiments of the disclosure are shown. This disclosure may, however, be embodied in many different forms and should not be construed as limited to the illustrated embodiments set forth herein; rather, these embodiments are provided so that this disclosure will be through and complete, and will fully convey the scope of the disclosure to those skilled in the art. Like numbers refer to like elements throughout.

Figure 1:
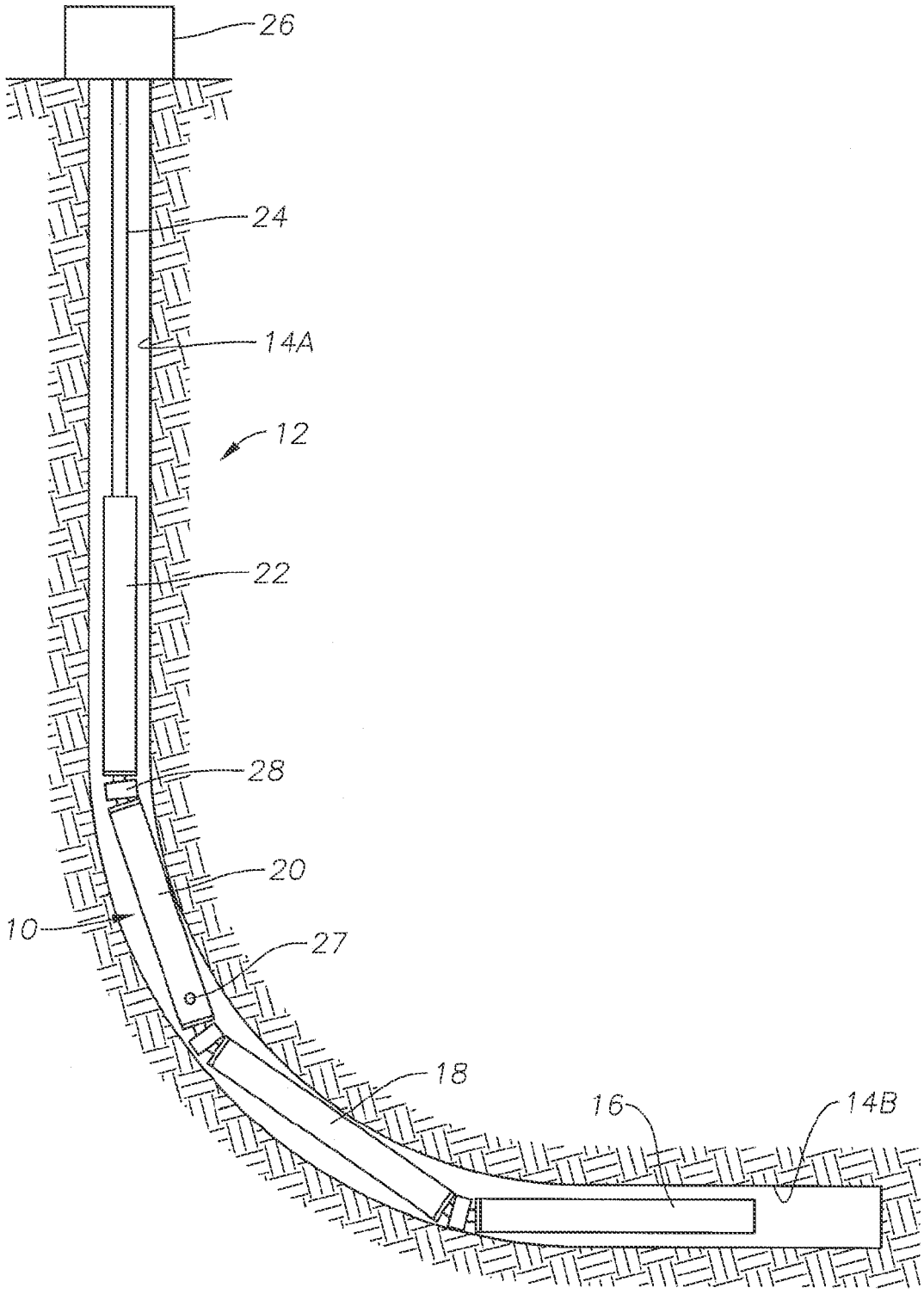
FIG. 1 is a side partial sectional view of an example of an electrical submersible pumping (ESP) system disposed in a deviated wellbore in accordance with the present disclosure.

FIG. 1 is a side partial sectional view of an example of an electrical submersible pump assembly 10 deployed within a wellbore 12 that has a vertical portion 14A and a deviated portion 14B, both normally being cased. Deviated portion 14B may be horizontal. The embodiment of the pump assembly 10 illustrated includes a motor 16 on its lower end whose upper end is coupled with a seal section 18. Seal section 18 has means, such as a bladder, for reducing a pressure differential between lubricant in the motor and hydrostatic well fluid pressure. An optional separator 20 is shown attached on an upper end of seal section 18 and distal from motor 16. A pump 22 is shown mounted onto an end of separator 20 distal from seal section 18. Production tubing 24 is shown connected to an end of pump 22 opposite separator 20 and extending upward through the wellbore 12. An upper end of the production tubing 24 terminates within a wellhead assembly 26 shown mounted on surface above an opening to the wellbore 12. An inlet 27 is shown formed through a side wall of separator 20 which allows for fluid within wellbore 12 to enter the pump assembly 10. Inside the separator 20, different phases within the fluid (not shown) are isolated from one another. Liquid extracted from the wellbore fluid is directed to the pump 22, where it is pressurized and delivered, to production tubing 24 for delivery to the wellhead assembly 26. The vapor fraction of the wellbore fluid can be directed up the wellbore 12 to the wellhead assembly 26, and outside of the pump assembly 10. Embodiments of a pump assembly 10 not having a separator 20 exist, in these embodiments inlet 27 may be provided on the pump 22.

The segments of the pump assembly 10, e.g., motor 16, seal section 18, separator 20, and pump 22, are connected to one another by connectors 28 shown set between each adjacent segment. Each connector 28 is pivotable, so that the segments that it joins can pivot relative to each other When passing through the transition between well vertical portion 14A and horizontal portion 14B. That is, each segment can pivot into an orientation with its axis oblique to an axis of an adjacent segment. Thus when the pump assembly 10 encounters a curved transition in the wellbore 12, the pivoting connectors 28 introduces pliability to the pump assembly 10 so it can flex to a curved shape of the wellbore 12 and be inserted past the bend in the wellbore 12.

Alternately, some of the connectors between segments could be rigid, non pivoting types, and others could be pivotal connectors 28. As an example, some of the segments of pump assembly 10 are much longer than others, such as a length of motor 16 versus seal section 18. An operator may choose to employ a rigid connection between motor 16 and seal section 18, as an example. Also, motor 16 could be tandem motors coupled together and pump 22 could comprise, tandem pumps 22. The tandem components could be coupled together by conventional rigid connectors or by pivotal connectors 28.

Figure 2:
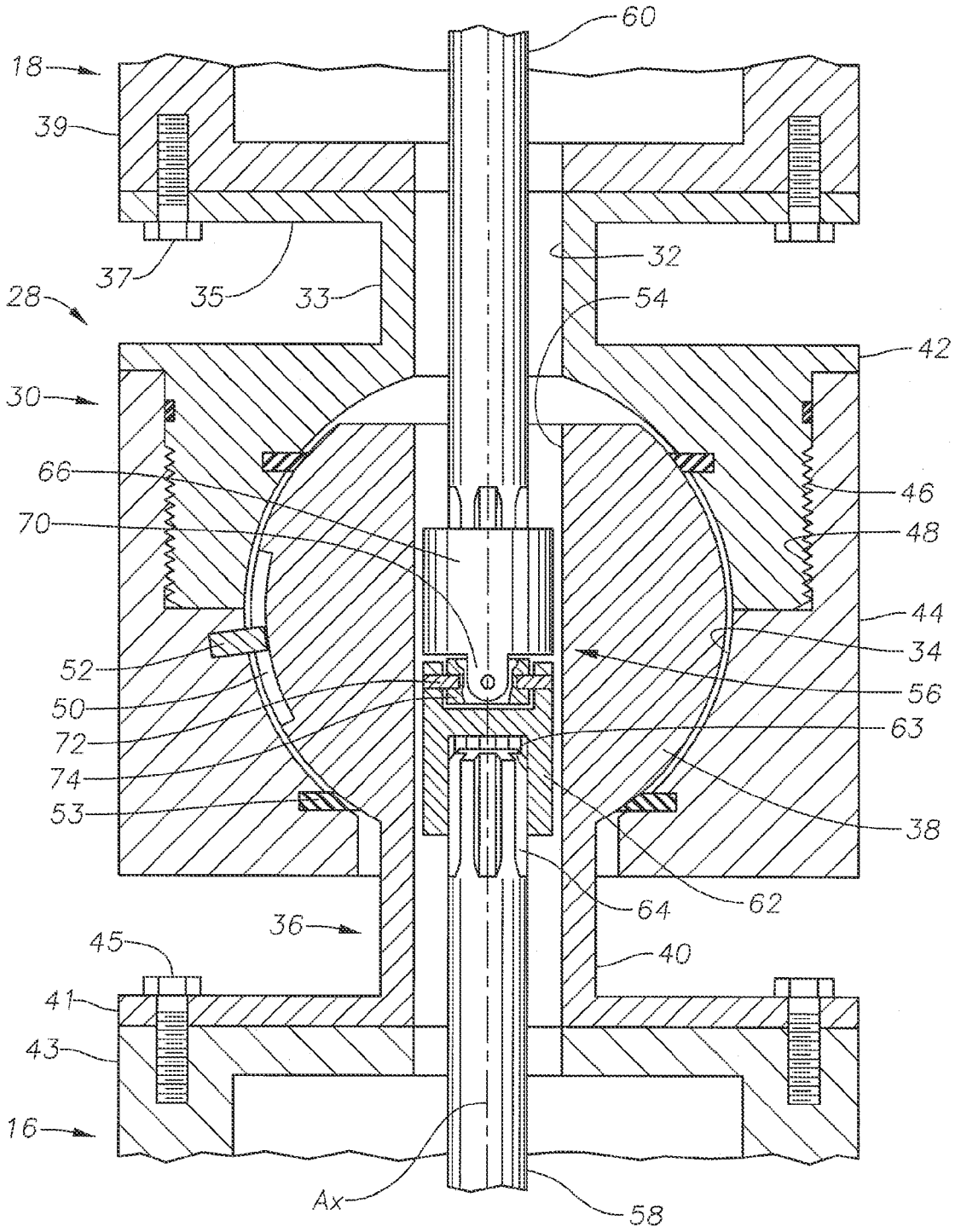
FIG. 2 is a side sectional view of an example of a connector for pivotingly connecting adjacent segments of the ESP system of FIG. 1 and in accordance with the present disclosure.

Referring now to FIG. 2, an example of a connector 28 is shown in a side sectional view. FIG. 2 illustrates the connector 28 connecting between seal section 18 and motor 16, but the description applies to the other modules of pump assembly 28, as well. Further, even though connector 28 is shown connecting motor 16 with seal section 18, a conventional non pivotal connector could be employed between motor 16 and seal section 18, and pivotal connector 28 employed elsewhere in pump assembly 10.

Connector 28 includes a housing connector or socket assembly 30 having a passage or bore 32 extending along an axis $A_x$ of the socket assembly 30. A curved cavity 34, which may be spherical, is formed within the socket assembly 30 and circumscribes a mid-portion of bore 32; socket cavity 34 movably receives therein a male portion 36 of socket assembly 30. The male portion 36 of socket assembly 30 has a curved member shown to be spherically-shaped ball 38 shown set within cavity 34.

Socket assembly 30 has an annular collar 33 with an external flange 35 on an end opposite cavity 34. External flange 35 threadingly secures to a housing 39 of seal section 18, such as by bolts 37. Alternately, flange 35 could be rigidly connected in other manners, such as by external threads on flange 35 that engage internal threads in seal section housing 39.

Male portion 36 has an annular collar 40 extending downward from ball 38 to outside of the socket assembly 30. Collar 40 has a flange 41 that threadingly couples to a housing 43 of motor 16, such as by bolts 45. Alternately, the outer diameter of flange 41 could have external threads that engage internal threads in housing 43. Connector 28 could be inverted with flange connecting to seal section 18 and flange 35 rigidly connecting to motor 16.

The socket assembly 30 is shown having a male end 42 that threadingly couples to a female end 44, where female end 44 circumscribes a portion of the ball 38 adjacent collar 40, and also circumscribes a portion of collar 40. Male end 42 circumscribes a portion of ball 38 distal from collar 40. Included with male end 42 is an annular external pin portion 46 that extends axially towards the collar 40 and has threads provided along at least some of its outer surface. Pin portion 46 inserts into a box 48 that is coaxially formed within female end 44 and configured to receive pin portion 46 therein. Threads provided along an inner surface of box 48 mate with threads on the outer portion of pin 46 to form a threaded connection that extends coaxially around axis $A_x$. In one example of assembly of the connector 28, while male and female ends 42, 44 are initially disconnected from one another, ball portion 36 inserts into spherical cavity 34 and is oriented so that collar 40 projects through an opening formed in the side of female end 44 formed by bore 32. With ball 38 positioned inside cavity 34, the pin 46 on male end 42 can be inserted within box 48 on female end 44, and a threaded connection formed to couple together male and female ends 42, 44.

A slot 50 and key 52 are located between ball 38 and spherical cavity 34 to restrict pivotal movement of ball 38 in cavity 34 to a single plane. FIG. 2 shows key 52 mounted to a circumferential portion of cavity 34 and slot 50 on ball 38, but that arrangement could be reversed. Slot 50 is elongated more than a height of key 52 to enable ball 38 to pivot at oblique angle relative to axis Ax. Slot 50 and key 52 prevent rotation of ball 38 in socket 34 about axis Ax, thus connectors 28 prevent axial rotation of the housings of the various segments of ESP 10 relative to each other. Arrangements other than slot 50 and key 52 are feasible to prevent rotation of ball 38 in cavity 34 about axis Ax are feasible.

Still referring to FIG. 2, a passage or bore 54 is shown formed axially through the ball portion 36 and generally coaxial with axis $A_x$. Bore 54 is in fluid communication with passage 32, and both are in fluid communication with interior portions of seal section 18 and motor 16. Preferably bores 32 and 54 are sealed from exterior well fluid, and this may be done with seals 53 that seal between socket cavity 34 and ball 38. In this example, one seal 53 is mounted to male end 42 within cavity 34 and another to female end 44 within cavity 34, but other arrangements are feasible.

A pivotal shaft connector or coupling assembly 56, shown set within bore 54, rotationally couples motor shaft 58 to seal section shaft 60. Shaft coupling assembly 56 transmits torque between shafts 58, 60 and allows shafts 58, 50 to tilt oblique to axis Ax. Shaft coupling assembly 56 is preferably a universal joint. In the example of FIG. 2, shaft coupling assembly 56 has a first coupling member 62 and a second coupling member 66. First coupling member 62 is shown in cross section, and second coupling member 66 is shown in a side view. Each coupling member 62, 66 has an internal splined receptacle 63. Each shaft 58, 60 has a splined end 64 that inserts into and meshes with one of the splined receptacles 63.

Each shaft coupling member 62, 66 has circumferentially spaced apart lugs 70 on the end opposite its splined receptacle 63. Lugs 70 extend axially and are spaced apart 180 degrees. Pins 72 extend between lugs 70 and a central gimbal 74, which may be a cylindrical disk. Lugs 70 and pins 72 on one of the coupling members 62, 66 are spaced 90 degrees from those on the other coupling member 62, 66. Coupling members 62, 66 allow tilting of shafts 58, 60 relative to each other, but still transmit rotation. Shaft coupling assembly 56 is centrally located within ball bore 54 and sealed from well fluids by seals 53. Other types of shaft coupling assemblies 56 rather than the universal joint shown are feasible.

During operation, the operator secures the various segments, such as motor 16, seal section 18, pump 20, and optionally gas separator 22 with connectors, at least one of which will be a pivotal connector 28. While lowering the pump assembly 10 in cased well 12, the segments can pivot relative to each other when reaching the transition between the vertical portion 14A and the inclined portion 14B of well 12. While pivoting, ball 38 will pivot relative to cavity 34 oblique to axis Ax, rotating about a center point of ball 38 along the portion of axis Ax within ball bore 54. Similarly, shaft coupling 62 will pivot relative to shaft coupling 66 about a center point of gimbal 74 perpendicular to the portion of axis Ax passing through shaft coupling 56. The center or pivot points of socket assembly 30 and shaft connector 56 may coincide with each other.

When reaching the desired depth, typically pump assembly 10 will be within a straight portion of the inclined section 14B of well 12. Motor 16, seal section 18, separator 20 and pump 22 will again be co-axial with each other. The operator supplies electrical power to motor 16, which causes shaft 58 to rotate. Shaft coupling 56 transmits the rotation to seal section shaft 60. The various couplings between the shafts of the segments of pump assembly 10 cause pump 22 to operate and pump fluid from the well. Housings 39 and 43 of seal section 18 and motor 16 do not rotate about their axes. Slot and key 50, 52 prevent housings 39 and 43 front axial rotation relative to each other. Pump assembly 10 can also be operated with segments within a curved transition of well 12. Shaft coupling 56 will transmit rotation of shaft 58 to shaft 60 even when the axis of shaft 58 is inclined relative to the axis of shaft 60.

It is understood that variations may be made in the above without departing from the scope of the disclosure. While specific embodiments have been shown and described, modifications can be made by one skilled in the art without departing from the spirit or teaching of this disclosure. The embodiments as described are exemplary only and are not limiting. Many variations and modifications are possible and are within the scope of the disclosure. Accordingly, the scope of protection is not limited to the embodiments described, but is only limited by the claims that follow, the scope of which shall include all equivalents of the subject matter of the claims.

The invention claimed is:

1. An electrical submersible pump assembly disposable within a wellbore comprising:

segments attached end to end and including a motor, a pump, and a seal section between the pump and the motor;

a first one of the segments having a cylindrical first housing and a rotatable first shaft mounted therein that is rotatable about a first housing axis;

a second one of the segments having a cylindrical second housing and a second shaft mounted therein that is rotatable about a second housing axis;

a pivotal housing connector attached between the first and second housings, the pivotal housing connector having a socket rigidly attached to the first housing and a ball pivotally received in the socket and rigidly attached to the second housing;

a mating key and elongated slot arrangement between the socket and the ball that prevents rotation of the first housing about the first housing axis relative to the second housing about the second housing axis, but allows pivotal movement of the first and second housings relative to each other in a single plane containing the first and second housing axes; and at least one pivotal shaft connector attached between the shafts of the adjacent ones of the segments, the shaft connector allowing pivoting of the shafts of the adjacent ones of the segments.

2. The assembly according to claim 1, wherein the pivotal shaft connector is mounted within the pivotal housing connector.

3. The assembly according to claim 1, wherein the socket of the pivotal housing has a first end with threads concentric with first housing axis and a second end with threads concentric with first housing axis, the threads of the first end and second end being secured together.

4. The assembly according to claim 1, wherein:

the pivotal housing connector has first and second flanges facing in opposite directions;

the first flange is secured by threads to the first housing; and the second flange is secured by threads to the second housing.

5. The assembly according to claim 1, wherein:

the key and elongated slot arrangement comprises a key mounted to one of the socket and the ball and an elongated slot on the other of the socket and the ball, the key extending into the slot and sliding along the slot while the first and second housings pivot relative to each other.

6. The assembly of claim 5, wherein the elongated slot is contained in located in an axial plane that also contains the first and second housing axes.

7. The assembly of claim 6, wherein the key and elongated slot arrangement allows pivotal movement of the first and second housings relative to each other only in the axial plane.

8. The assembly of claim 1, wherein:

the socket has a spherical cavity in which the ball is received and a socket passage that places the cavity in fluid communication with an interior of the first housing; and the ball has a ball passage extending therethrough that places the cavity and the socket passage in fluid communication with an interior of the second housing.

9. The assembly of claim 1, wherein the at least one pivotal shaft connector comprises a universal joint.

10. A submersible well pump assembly, comprising:

a plurality of modules, including a pump module, a motor module, and a seal section module located between the motor module and the pump module;

a first one of the modules having a cylindrical first housing and a first shaft mounted therein that is rotatable about a first housing axis;

a second one of the modules having a cylindrical second housing and a second shaft mounted therein that is rotatable about a second housing axis;

a pivotal housing connector joining the first and second housings, the pivotal housing connector having a socket assembly secured to the first housing, the pivotal housing connector having a ball element secured to the second housing, the socket assembly having a cavity that receives the ball element;

a universal joint extending through the housing connector and joining the first and second shafts together;

a mating key and elongated slot arrangement between a spherical surface of the cavity and a spherical surface of the ball element that prevents rotation of the socket assembly relative to the ball element about the first housing axis; and wherein the key and elongated slot arrangement allows tilting movement of the first and second housings relative to each other and the first and second shafts relative to each other in a single plane that contains the first and second housing axes.

11. The assembly according to claim 10, wherein:

the socket assembly has a socket passage that places the cavity in fluid communication with an interior of the first housing; and the ball element has a ball passage extending therethrough that places the cavity and the socket passage in fluid communication with an interior of the second housing.

12. The assembly according to claim 11, wherein the key and elongated slot arrangement comprises a key mounted to one of the spherical surfaces and an elongated slot formed in the other of the spherical surfaces that receives the key, the key sliding along the slot while tilting movement of the first and second housings relative to each other occrs.

13. The assembly according to claim 10, further comprising:

a first flange on a first end of the housing connector that bolts to the first housing;

a first neck on the socket assembly that is of smaller outer diameter than an outer diameter of the first flange and which joins the first flange;

a second flange on a second and opposite end of the housing connector that bolts to the other of the housings; and a second neck on the ball element that is of smaller outer diameter than an outer diameter of the second flange and which joins the second flange.

14. The assembly according to claim 10, wherein:

the socket assembly has a first member secured to the first housing, the first member containing a portion of the cavity and having first member threads concentric with first housing axis, the socket assembly having a second member containing a remaining portion of the cavity and having second member threads concentric with first housing axis, the first and second member threads being secured together.

15. The assembly according to claim 10, wherein each of the shafts has a splined end, and the universal joint comprises:

a first coupling having a splined receptacle that meshes with the splined end of the first shaft; and a second coupling having a splined receptacle that meshes with the splined end of the second shaft, the first and second couplings being pivotally joined to each other so as to transmit torque from one of the shafts to other of the shafts and allow pivotal movement of the shafts relative to each other.

16. The assembly according to claim 10, wherein each of the shafts has a splined end, and the universal joint comprises:

a first coupling having a splined receptacle that meshes with the splined end of first shaft;

a second coupling having a splined receptacle that meshes with the splined end of the second shaft;

a central gimbal;

first lugs on opposite sides of the first coupling and pinned to the gimbal to allow pivotal movement of the first coupling relative to the central gimbal; and second lugs on opposite sides of the second coupling and pinned to the gimbal 90 degrees from the first lugs to allow pivotal movement of the second coupling relative to the central gimbal.

17. The assembly according to claim 10, wherein the key and elongated slot arrangement comprises:

a key mounted to one of the spherical surfaces and an elonated slot formed in the other of the spherical surfaces that receives the key;

the slot extending in a plane that contains the first housing axis and the second housing axis; and the slot having a greater length than a width of the key to enable the key to slide along the slot during pivotal movement of the first and second housings relative to each other.

18. A submersible well pump assembly, comprising:

a plurality of modules, including a pump module, a motor module, and a seal section module located between the motor module and the pump module;

a first one of the modules having a cylindrical first housing and a first shaft mounted therein that is rotatable about a first housing axis;

a second one of the modules having a cylindrical second housing and a second shaft mounted therein that is rotatable about a second housing axis;

a first socket member rigidly secured to the first housing, the first socket member having a first cavity portion therein;

a ball element having a spherical surface on an exterior that has a first portion received within the first cavity portion, the ball element being rigidly secured to the second housing;

a second socket member having a second cavity portion therein that registers with the first cavity portion to define a cavity with a spherical surface, the second cavity portion receiving a second portion of the ball to retain the ball in the spherical cavity, the second socket member being releasably and rigidly secured to the first socket member;

the first socket member having a socket passage that is coaxial with the first housing axis;

the ball element having a ball passage therethrough that is coaxial with the second housing axis;

the socket passage and the ball passage providing fluid communication between an interior of the first housing and an interior of the second housing;

a universal joint within the ball passage and joining the first and second shafts together;

an elongated slot formed in one of the spherical surfaces, the slot being located in a plane that contains the first and second housing axes; and a key protruding from the other of the spherical surfaces into the slot, the key being slidable in the slot as the first and second housings tilt relative to each other.

* * * * *